US011142378B1

(12) United States Patent
Laska

(10) Patent No.: US 11,142,378 B1
(45) Date of Patent: Oct. 12, 2021

(54) CONTAINER WITH LID INCLUDING FRANGIBLE PROJECTING TAB

(71) Applicant: Kimberly-Clark Worldwide, Inc., Neenah, WI (US)

(72) Inventor: Christopher B. Laska, Fremont, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 17/271,511

(22) PCT Filed: Dec. 19, 2019

(86) PCT No.: PCT/US2019/067350
§ 371 (c)(1),
(2) Date: Feb. 25, 2021

(87) PCT Pub. No.: WO2021/126198
PCT Pub. Date: Jun. 24, 2021

(51) Int. Cl.
*B65D 51/22* (2006.01)
*B65D 43/16* (2006.01)
*B65D 83/08* (2006.01)

(52) U.S. Cl.
CPC ..... *B65D 51/228* (2013.01); *B65D 43/162* (2013.01); *B65D 83/0805* (2013.01); *B65D 2251/009* (2013.01); *B65D 2251/0021* (2013.01)

(58) Field of Classification Search
CPC ..... B65D 83/0835; B65D 83/0811; B65D 43/164; B65D 43/16; B65D 2251/0093;
(Continued)

(56) References Cited

U.S. PATENT DOCUMENTS 3,186,623 A * 6/1965 Guyer ..... B65D 5/542 229/207
4,185,754 A 1/1980 Julius
(Continued)

FOREIGN PATENT DOCUMENTS

CN 2332335 Y 8/1999
CN 2499357 Y 7/2002
(Continued)

OTHER PUBLICATIONS

Souq, "Caboo Bamboo Baby Wipes 30ct Pack Pull Tab", https://uae.souq.com/qa-en/caboo-bamboo-baby-wipes-30ct-pack-pull-tab-35945430/i/.

*Primary Examiner* — Robert J Hicks
*Assistant Examiner* — Tia Cox
(74) *Attorney, Agent, or Firm* — Kimberly-Clark Worldwide, Inc.

(57) ABSTRACT

A storing and dispenser container for a plurality of sheets of product can include a container body. The container body can include a top portion. The top portion can include a removable portion. The container can also include a flange defining an interior portion. The flange can be coupled to the top portion of the container body. The interior portion can be defined by the flange and surround the removable portion of the container body. The container can also include a frangible projecting tab extending from the flange into the interior portion of the flange and over the removable portion of the container body. The frangible projecting tab can be coupled to the removable portion of the container body. The container body can further include a lid coupled to the flange.

20 Claims, 7 Drawing Sheets

(58) Field of Classification Search
CPC ..... B65D 2577/205; B65D 51/228; B65D 43/162; B65D 77/38; B65D 77/20; B65D 83/0805
USPC ..... 206/449, 494, 812, 223; 220/836, 810, 220/359.2, 359.3, 359.1
See application file for complete search history.

(56) References Cited

U.S. PATENT DOCUMENTS

| | | | | |
|---|---|---|---|---|
| 4,679,693 | A | 7/1987 | Forman | |
| 6,702,109 | B1 | 3/2004 | Tabuchi | |
| 7,172,093 | B2 * | 2/2007 | Bando | B65D 83/0805 206/494 |
| 7,303,092 | B2 | 12/2007 | Sarbo et al. | |
| 7,703,602 | B2 | 4/2010 | Saito et al. | |
| 2006/0138137 | A1 | 6/2006 | Casale et al. | |
| 2006/0151515 | A1 * | 7/2006 | Hood | B65D 75/5877 221/29 |
| 2008/0179326 | A1 * | 7/2008 | Krauth | B65D 75/5838 220/260 |
| 2008/0253697 | A1 | 10/2008 | John | |
| 2009/0289078 | A1 * | 11/2009 | Melin | A47K 10/421 221/45 |
| 2012/0318798 | A1 * | 12/2012 | Domoy | B65D 51/20 220/258.2 |
| 2014/0001072 | A1 * | 1/2014 | Christoffel | B65D 75/5833 206/459.5 |
| 2014/0001196 | A1 * | 1/2014 | Bushman | B65D 83/08 221/45 |
| 2015/0266633 | A1 * | 9/2015 | Cameron | B65B 11/48 206/484.2 |
| 2016/0007812 | A1 * | 1/2016 | Yamada | B65D 83/0894 206/494 |
| 2016/0106273 | A1 * | 4/2016 | Yamada | B65D 83/0805 221/1 |
| 2016/0159534 | A1 * | 6/2016 | Ujiie | B65D 75/5894 206/494 |
| 2017/0150852 | A1 * | 6/2017 | Park | A47K 10/421 |
| 2018/0160868 | A1 * | 6/2018 | Ma | B08B 1/006 |
| 2019/0177056 | A1 * | 6/2019 | Wang | B65D 43/162 |

FOREIGN PATENT DOCUMENTS

| | | | |
|---|---|---|---|
| CN | 202670443 | U | 1/2013 |
| JP | 2005178844 | A | 7/2005 |
| JP | 4986221 | B2 | 7/2012 |
| WO | 09126081 | A1 | 10/2009 |

* cited by examiner

CONTAINER WITH LID INCLUDING FRANGIBLE PROJECTING TAB

BACKGROUND OF THE DISCLOSURE

There are a variety of storing and dispensing containers in the market, particularly those for storing and dispensing absorbent sheet type products, such as wipes. Wipe type products or wipes have been made from a variety of materials which can be dry or wet when used. Wet wipes can be moistened with a variety of suitable wiping solutions. Often, wet wipes are stacked in a container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Sometimes each folded wet wipe is interfolded with the wet wipes immediately above and below it in the stack of wipes. In an alternative configuration, the wet wipes have been placed in a container in the form of a continuous web of material that includes perforations adapted to allow for separation of individual wet wipes from the web upon the application of a pulling force. Such wet wipes have been used for baby wipes, face and hand wipes, personal care wipes, household cleaning wipes, industrial wipes and the like.

Conventional packages of wipes have typically been designed to be positioned on a flat surface such as a countertop, table or the like. Such conventional packages have often included a plastic container, tub or package which provides a sealed environment for the wet wipes to ensure that they do not become dirty or overly dry. Some of the conventional packages have also been configured to provide "one-at-a-time" dispensing of each wet wipe which can be accomplished using a single hand after the package has been opened. Such single-handed, one-at-a-time dispensing is particularly desirable because the other hand of the user or care giver is typically required to be simultaneously used for other functions. For example, when changing a diaper product on an infant, the care giver typically uses one hand to hold and maintain the infant in a desired position while the other hand is used to dispense a baby wipe to clean the infant.

"Pop-up" configurations of wet wipe dispensers can advantageously help provide the aforementioned single-handed, "one-at-a-time" dispensing. In "pop-up" configurations, when a wipe is removed from the dispenser, the wipe pulls along the leading end of the succeeding wipe in the package, by virtue of the succeeding wipe being in operative contact with the leading wipe such as via interfolding, via adhesive bonding, or via an integral connection along a line of weakness. Preferably, as the leading wipe is pulled out of and away from the package, the trailing end of the leading wipe breaks free from the leading end of the succeeding wipe, and the leading end of the succeeding wipe is left protruding from the package. In this way, the leading end of the succeeding wipe is immediately and automatically positioned for grasping and subsequent withdrawal from the package, and what was previously the succeeding wipe now becomes the leading wipe.

Historically, two malfunctions can occur during the operation just described. In one scenario, as the leading wipe is withdrawn, the leading wipe may not properly release from the succeeding wipe, with the result that the succeeding wipe is pulled too far or even entirely out of the package. A situation in which one or more succeeding wipes are in a single pull operation withdrawn from the package by virtue of being in operative contact with the leading wipe is referred to herein as "multiples." Multiples can result from excessively strong connections between successive wipes (e.g., too much adhesive or insufficient web perforations), or can result from a dispensing orifice that does not sufficiently hold in place the succeeding wipe to allow the leading wipe to break free (e.g., too large of a dispensing orifice).

In another scenario, as the leading wipe is withdrawn, the succeeding wipe, after breaking free from the leading wipe, may not be readily accessible for subsequent dispensing. For example, although the leading end of the succeeding wipe may momentarily protrude from the package as it follows the leading wipe during withdrawal of the leading wipe, the leading end of the succeeding wipe often subsequently falls back through the dispensing orifice into the dispensing container—herein referred to as a "fallback." Fallbacks can result from insufficiently strong connections between successive wipes (i.e., not enough adhesive or an excessively weak line of weakness), or can result from a dispensing orifice that does not sufficiently hold the leading edge of the succeeding wipe in an outwardly protruding manner (i.e., too large of a dispensing orifice).

Many wipes packages include a flexible pouch to which a rigid closed-loop flange is attached. A rigid flip top is commonly hingedly attached to the flange. Within the closed-loop flange, the flexible pouch commonly includes a removable portion, which frequently includes a perforated perimeter and is depicted to the user as a dashed or solid line perimeter. The removable portion is designed to be peeled away to define a dispensing orifice for the package, however, many users have difficulty initiating the tear along the outer perimeter of the removable portion. Often times, while trying to remove the removable portion the user can damage the product inside of the package, or can create bunching of the first or first several wipes within the package. Bunching of wipes can prevent improper dispensing of future wipes due to minimal "head space" between the top of the stack of wipes and the pouch material. As a result, wipes may become stuck or tear, which is frustrating to the consumer and can result in an inferior product experience. Furthermore, even if the first wipe properly dispenses, the next succeeding or further succeeding wipes may "fallback" as described earlier.

As a result, what is further lacking in the art is a container that has a rigid closed-loop flange and that provides more reliable removal of the removable portion of the container.

SUMMARY OF THE DISCLOSURE

In response to the aforementioned needs, a new storing and dispensing container for product has been invented.

In one embodiment, a storing and dispensing container is provided. The storing and dispensing container can be for a plurality of sheets of product. The container can include a container body including a top portion. The top portion can include a removable portion. The container can also include a flange defining an interior portion. The flange can be coupled to the top portion of the container body. The interior portion can be defined by the flange and can surround the removable portion of the container body. The container can further include a frangible projecting tab extending from the flange into the interior portion of the flange and over the removable portion of the container body. The frangible projecting tab can be coupled to the removable portion of the container body. The container body can further include a lid coupled to the flange.

In another embodiment, a storing and dispensing container is provided. The storing and dispensing container can be for a plurality of sheets of product. The container can include a container body including a top portion. The top portion can include a removable portion. The container can also include a flange defining an interior portion. The flange can be coupled to the top portion of the container body. The interior portion can be defined by the flange and can surround the removable portion of the container body. The container can include a frangible projecting tab extending from the flange into the interior portion of the flange. The frangible projecting tab can be configured to be pulled by a user to break away from the flange and at least partially separate the removable portion of the container body from the top portion of the container body. The container can further include a lid coupled to the flange.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the containers of the invention. Together with the description, the drawings serve to explain the various aspects of the invention.

BRIEF DESCRIPTION OF THE DRAWINGS

The present invention will be more fully understood and further features will become apparent when reference is made to the following detailed description of the invention and the accompanying drawings. The drawings are merely representative and are not intended to limit the scope of the claims. Like parts of the containers depicted in the drawings are referred to by the same reference numerals.

DETAILED DESCRIPTION OF PARTICULAR EMBODIMENTS

In particular embodiments, the present disclosure pertains to a storing and dispensing container 10 for a plurality of sheets of product 12 configured as moist wipes. In preferred embodiments, the plurality of sheets of product 12 can be moist wipes, but it can be appreciated that the container 10 can house other types of products 12. The plurality of sheets of product 12 can be configured as a stack of products 12, however, other configurations are encompassed within the scope of this disclosure.

Figure 6:
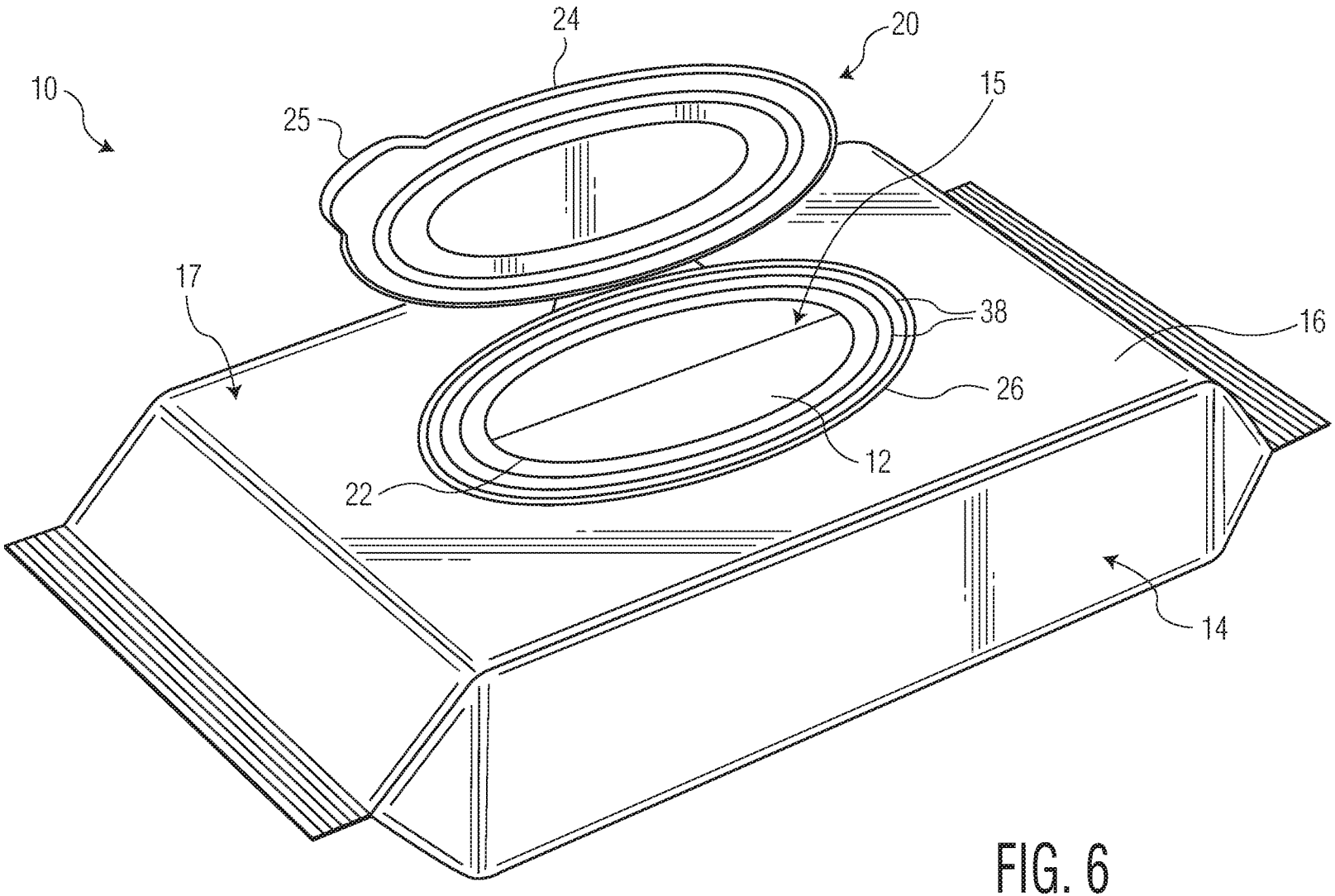
FIG. 6 representatively shows a perspective view of the example of FIG. 1 with the rigid flip top open and the frangible projecting tab and the removable portion of the container body being removed.
Figure 7:
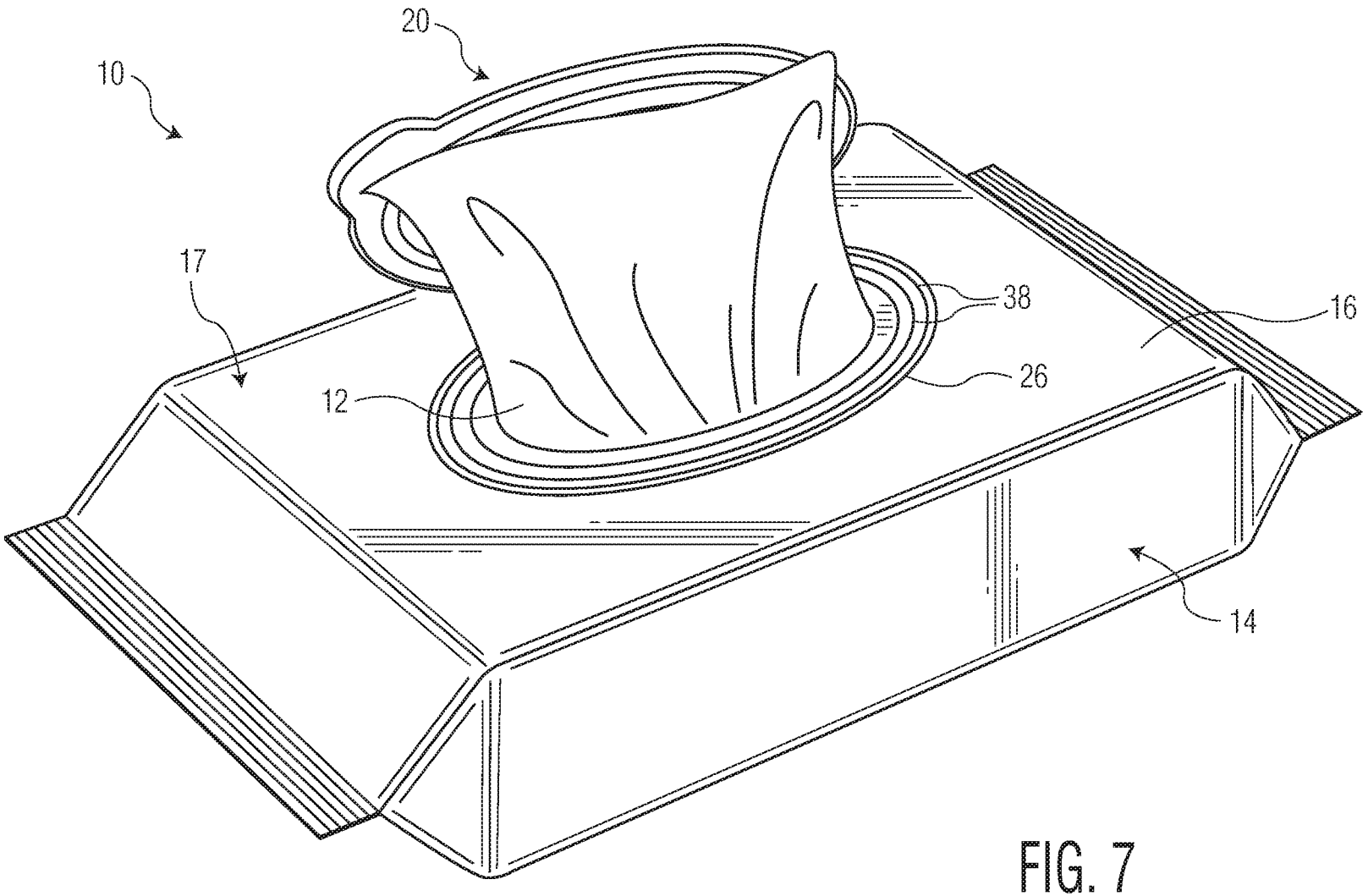
FIG. 7 representatively shows a perspective view of the example of FIG. 6 with a sheet of product being extracted from the container.

A container body 14 surrounds the plurality of sheet products 12. In a preferred embodiment, the container body 14 can be configured as a flexible film pouch. Preferably, the flexible film pouch is substantially moisture-impervious, especially for embodiments in which the plurality of sheet products are moist wipes or other products involving a wetting solution. The container body 14 can include a top portion 16. In particular embodiments, the top portion 16 includes a removable portion 18. The removable portion 18 can seal the stack of products 12 within the container body 14 when the container body 14 is in a first condition (as seen in FIG. 2, i.e., before the product 12 is dispensed the first time) and which allows access to the product 12 within the container body 14 in a second condition (i.e., when the removable portion 18 is removed and the rigid flip top 20 is in an open condition, as shown in FIGS. 6 and 7).

Figure 2:
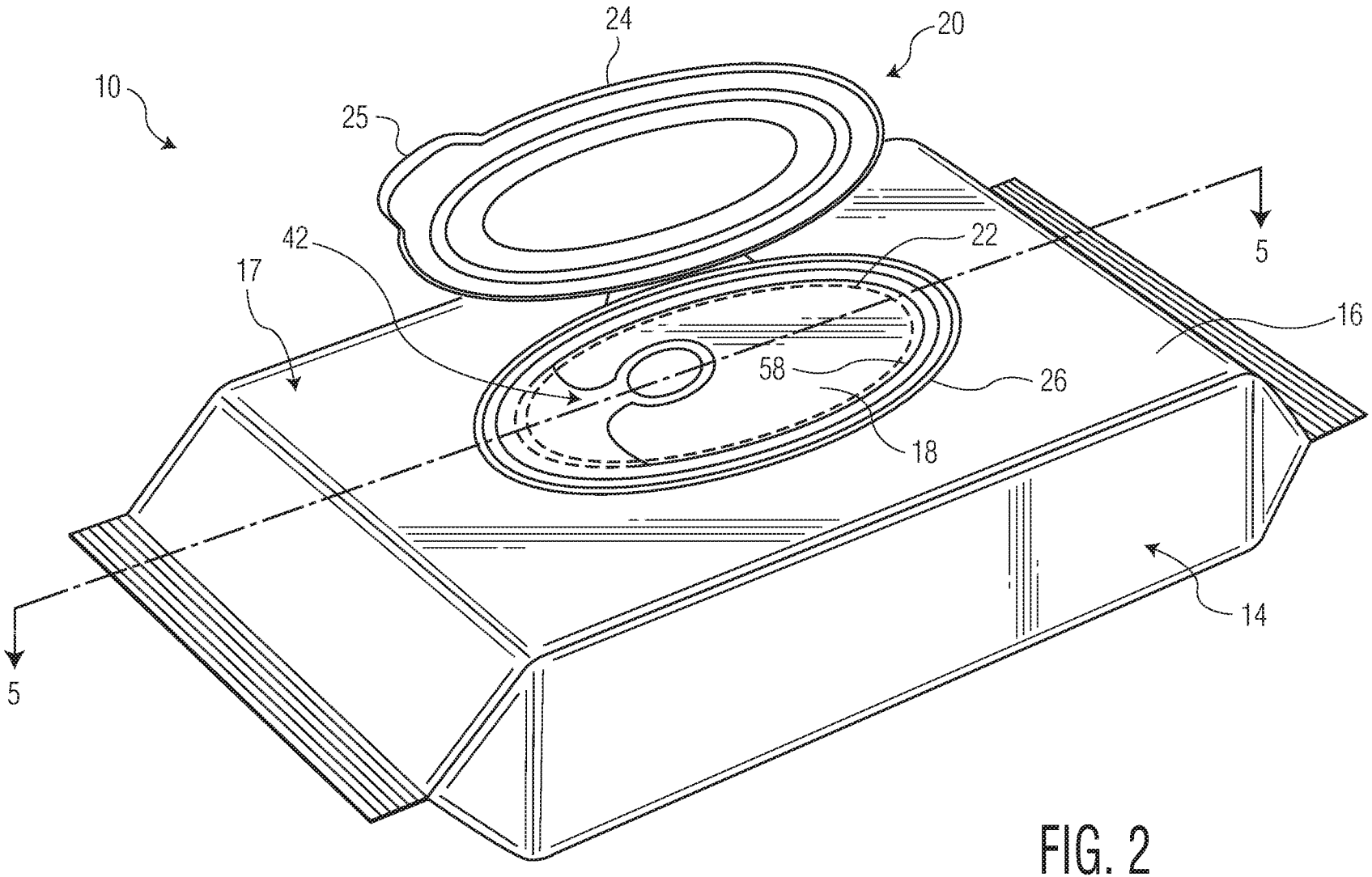
FIG. 2 representatively shows a perspective view of the example of FIG. 1 with the rigid flip top open.
Figure 3:
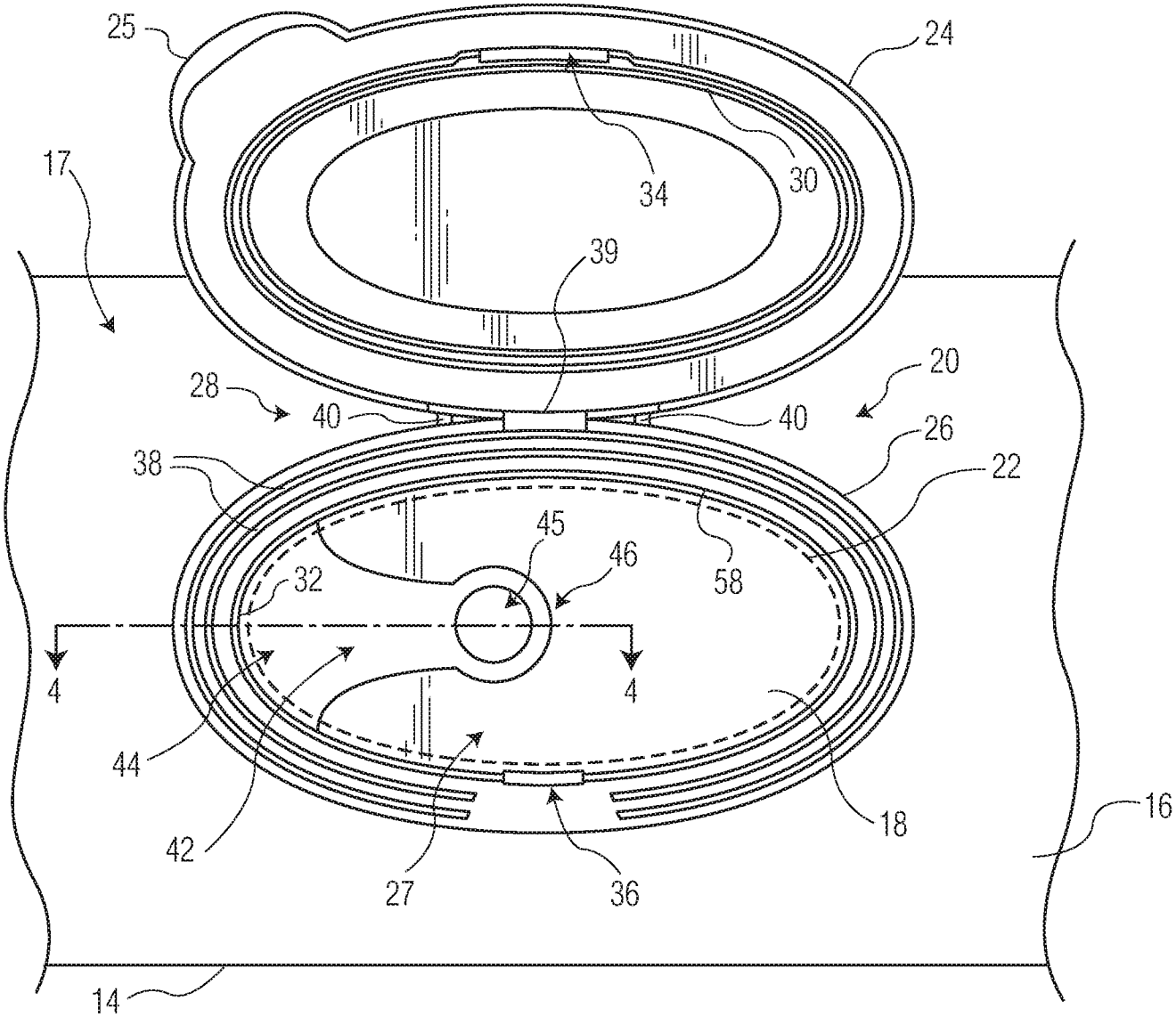
FIG. 3 representatively shows an enlarged top view of a rigid flip top in accordance with one embodiment of the invention, with the lid and the flange laid open flat to present the inside of the rigid flip top.

Referring to FIGS. 2 and 3, the removable portion 18 of the container body 14 may in particular embodiments be defined by a frangible line of weakness 22. Such line of weakness 22 can take the form of a line of intermittent perforations, such as a line of perforations provided by a die cutter, or could comprise a scored line formed in the container body 14. As will be discussed in further detail below, the removable portion 18 is adapted to be pulled off, peeled away, or otherwise removed from the container body 14 to provide a dispensing orifice 15 (as labeled in FIG. 6) providing access to the plurality of sheet products 12 disposed within the container body 14 such that the products 12 can be withdrawn from the container 10 as desired (as depicted in FIG. 7). In some embodiments, the removable portion 18 can be in the form of a label, such as an adhesively attached label, which can be configured to be disposed of immediately after the initial opening of the container body 14.

The container 10 can also include a rigid flip top 20. The rigid flip top 20 can include a lid 24 connected to a flange 26 by a hinge 28. The flange 26 is coupled to the outer surface 17 of the container body 14 at the top portion 16 of the container body 14 and surrounds the dispensing orifice 15 in the container body 14. In some embodiments, the flange 26 can be coupled to the container body 14 by adhesive, but can be coupled to the container body 14 by other various mechanical and chemical methods known in the art, including, but not limited to, use of other bonding material, thermal bonding or welding, ultrasonic bonding or welding, or other joining methods as long as they create a permanent joined relationship between the container body 14 and the rigid flip top 20.

Figure 1:
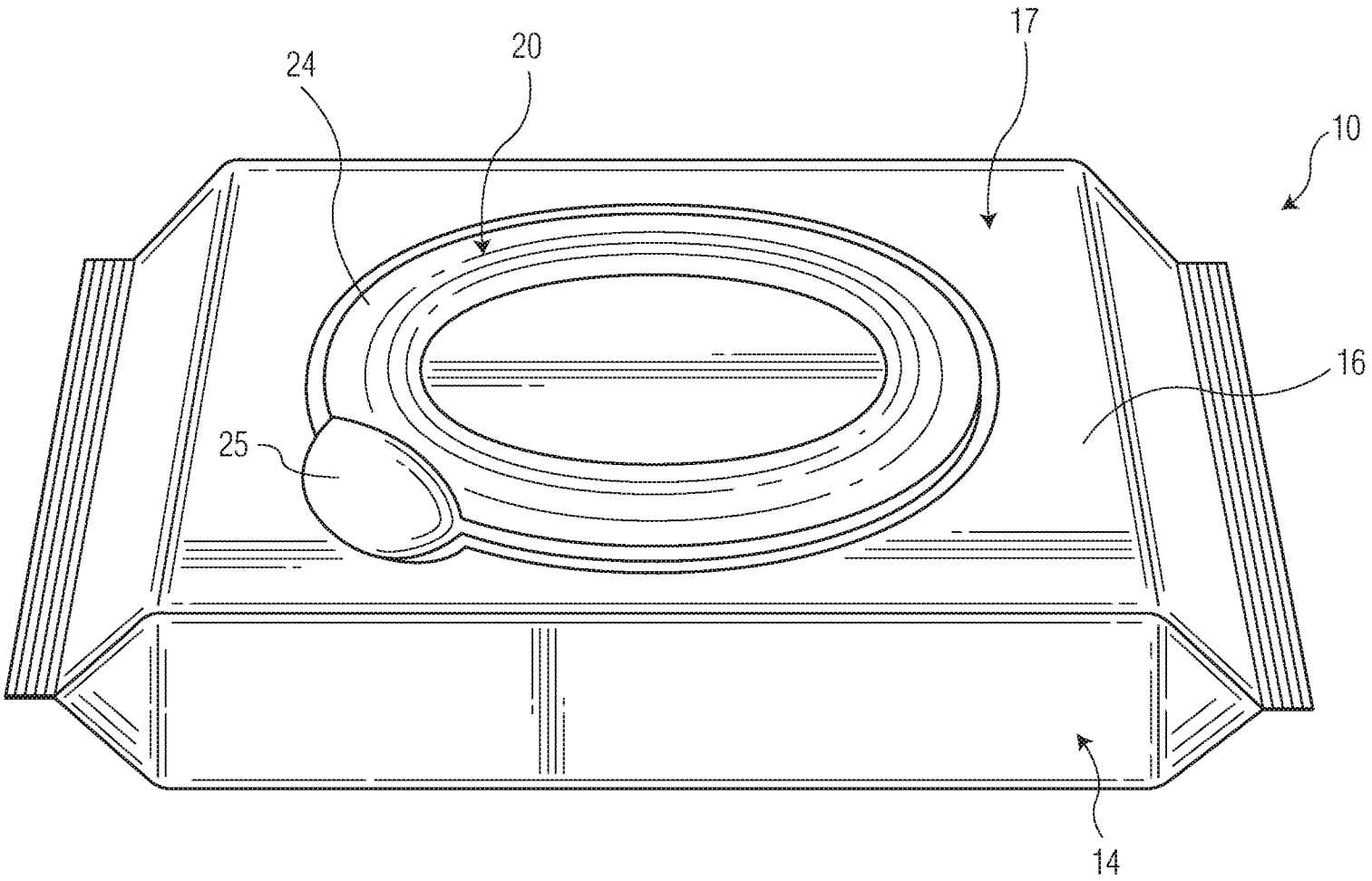
FIG. 1 representatively shows a perspective view of an example of a dispensing container for a plurality of sheets of product, such as wipes, suitable for use in conjunction with particular embodiments of the present invention with the rigid flip top lid closed.

The lid 24 is removably positionable to be closed (e.g., as seen in FIG. 1) to engage the flange 26 and thereby seal the container body 14 at the outer surface 17 where the removable portion 18 is surrounded by the flange 26 and covered by the lid 24, and to thus seal the container body 14 and plurality of products 12 therein from the environment outside the container body 14 after the removable portion 18 is removed and no further products 12 are desired during a particular dispensing occasion. In particular embodiments, the lid 24 can include an opening tab 25. The opening tab 25 is defined herein as any portion of the lid 24 that projects radially out from the lid 24 away from the sealing portion of the rigid flip top 20 and thereby enables a user to place at least one fingertip between the projecting portion and the container body 14 to assist in separating the lid 24 from the flange 26 when moving the lid 24 to the open position. The opening tab 25 protrudes from the rigid flip top 20 so that a user can more easily grasp it and have a more identifiable leverage point to open the lid 24. In particular embodiments, the opening tab 25 can be centered, or not centered, along a length of the lid 24. The lid 24 may be of a substantially uniform simple geometric shape (e.g., circle, oval, triangle, square, rectangle, pentagon, hexagon, septagon, etc.) except for the optional opening tab 25 projecting outwardly of the lid 24 perimeter.

When the lid 24 is positioned to be opened, such as depicted in FIG. 3, the flange 26 can define an interior portion 27 that can provide access to removable portion 18 of the container body 14, and after the removable portion 18 is removed, provide access to the dispensing orifice 15 in the container body 14 (as shown in FIGS. 6 and 7). As depicted in FIG. 3, the lid 24 can include an annular sealing ring 30 that extends downward from the inside of the lid 24 and that is sized to fit against an annular sealing ring 32 that extends upward from the inside of the flange 26, to assist in better sealing the lid 24 to the flange 26 when the lid 24 is closed. The lid 24 can include a latch 34, and the flange 26 can include a catch 36 designed to engage the latch 34 in an interference fit to keep the lid 24 closed to the flange 26. The flange 26 can optionally include one or more strengthening ribs 38 (two depicted in FIG. 3) around the flange 26 to stiffen the flange 26 as desired.

In particular embodiments, the rigid flip top 20 can include a hinge 28 between the lid 24 and the flange 26. The hinge 28 can be a living hinge, where "living hinge" means a hinge formed integrally with the members on either side of it. In some embodiments, the hinge 28 can include a central strap 39 and a pair of toggle straps 40, with each toggle strap 40 located on an opposite side of the central strap 39. The rigid flip top 20 can be made by a variety of conventional techniques, including, for example, injection molding.

The container 10 can also include a frangible projecting tab 42. While various embodiments of a frangible projecting tab 42, 142, 242, 342 are discussed and illustrated, it is noted that the discussion and benefits of any feature of one frangible projecting tab 42, 142, 242, 342 can apply to any other embodiment of a frangible projecting tab, unless otherwise noted herein. In preferred embodiments, the frangible projecting tab 42 forms part of the rigid flip top 20. In particular, the frangible projecting tab 42 can be coupled to the flange 26, while in other embodiments, the frangible projecting tab 42 can be integrally formed with the flange 26. The frangible projecting tab 42 can extend from the flange 26 into the interior portion 27 defined by the flange 26 and can extend over the removable portion 18 of the container body 14. The frangible projecting tab 42 can be coupled to the removable portion 18 of the container body 14, and as will be discussed in further detail below, can assist in removing at least a portion of the removable portion 18 of the container body 14.

Figure 4A:
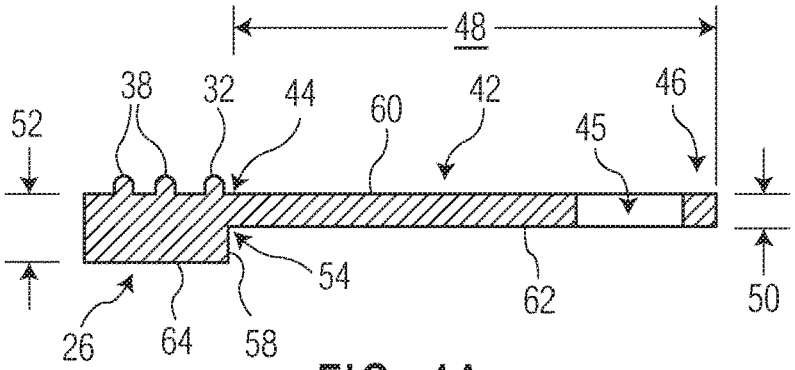
FIG. 4A representatively shows a cross-sectional view of the frangible projecting tab taken along line 4-4 in FIG. 3.

As depicted in FIGS. 3 and 4A, the frangible projecting tab 42 can include a proximal end 44 and a distal end 46. The proximal end 44 of the frangible projecting tab 42 can be the portion of the frangible projecting tab 42 that is coupled to the flange 26, or the portion of the frangible projecting tab 42 that is integrally formed to the flange 26. The distal end 46 can be the portion of the frangible projecting tab 42 that is furthest to the coupling, or integral formation, with the flange 26. The frangible projecting tab 42 can have a length 48 (as labeled in FIG. 4A). For purposes of discussion herein, the proximal end 44 of the frangible projecting tab 42 can be distinguished from the distal end 46 of the frangible projecting tab 42 in that each provides fifty percent of a total length 48 of the frangible projecting tab 42.

To help with opening of the container body 14, at least a portion of the proximal end 44 of the frangible projecting tab 42 can be coupled to the removable portion 18 of the top portion 16 of the container body 14. In some embodiments, the proximal end 44 of the frangible projecting tab 42 can be coupled to the removable portion 18 of the container body 14 with adhesive. Of course, the proximal end 44 of the frangible projecting tab 42 can be coupled to the removable portion 18 of the container body 14 via other suitable means without departing from the scope of this disclosure. Preferably, at least a portion of distal end 46 is not coupled to the removable portion 18 of the container body 14, as will be discussed in further detail below.

In some embodiments, the frangible projecting tab 42 can be configured such that the distal end 46 is generally circular in shape, as depicted in FIG. 3. In some embodiments, the distal end 46 can include an opening 45. The opening 45 can extend completely through the distal end 46 of the frangible projecting tab 42 in some embodiments. The opening 45 can be configured to be adequate size to allow a user's fingertip to pass through the opening 45 in helping to pull on the frangible projecting tab 42 and break the frangible projecting tab 42 and at least partially separate the removable portion 18 of the container body 14 from the top portion 16 of the container body 14 when a user opens the container body 14 to gain access to the sheet products 12 within the container 10.

The frangible projecting tab 42 can have a thickness 50, defined by a distance between the top surface 60 and the bottom surface 62 of the frangible projecting tab 42. In some embodiments, the frangible projecting tab 42 can have a thickness 50 that is substantially continuous throughout the length 48 of the frangible projecting tab 42, such as depicted in FIG. 4A. In other embodiments, the thickness 50 of the frangible projecting tab 42 may vary at different points along the length 48 of the frangible projecting tab 42. In some embodiments, the thickness 50 of the frangible projecting tab 42 can be less than a thickness 52 of the flange 26, as depicted in the embodiment illustrated in FIG. 4A and the alternative embodiments of a frangible projecting tab 242, 342 illustrated in FIGS. 4C and 4D. However, as depicted in another alternative embodiment of a frangible projecting tab 142 depicted in FIG. 4B, it is also contemplated that the thickness 50 of the frangible projecting tab 142 can be substantially the same as the thickness 52 of the flange 26. As will be discussed in more detail below, the thickness 50 and/or the length 48 of the frangible projecting tab 42 can help provide an enhanced bending moment in order to break the frangible projecting tab 42 to assist with separating at least a portion of the removable portion 18 of the container body 14 from the top portion 16 of the container body 14.

The frangible projecting tab 42 can include an area of weakness 54. The area of weakness 54 can be an area of the tab 42 that is configured to break upon a force applied to a portion of the frangible projecting tab 42. In some embodiments, such as the embodiments depicted in FIGS. 4B, 4C, and 4D, the area of weakness 54 can be an area of the frangible projecting tab 142, 242, 342 that has a thickness that is less than a thickness of an adjacent area of the frangible projecting tab 142, 242, 342. For example, the area of weakness 54 can be a scored line 56 in the frangible projecting tab 142, 242, 342. In other embodiments, such as the embodiment of the frangible projecting tab 42 illustrated in FIG. 4A, the area of weakness 54 can be a portion of the frangible projecting tab 42 at the junction of the proximal end 44 of the frangible projecting tab 42 and the flange 26. This junction of the proximal end 44 of the frangible projecting tab 42 and the flange 26 can provide an area of weakness 54 in that the proximal end 44 of the frangible projecting tab 42 has a thickness 50 that is less than a thickness 52 of the flange 26 adjacent the frangible projecting tab 42.

In some embodiments, the area of weakness 54 can be substantially aligned with an interior edge 58 of the flange 26. The interior edge 58 of the flange 26 can define the interior portion 27 of the flange 26, as illustrated in FIGS. 2 and 3. As one example, the area of weakness 54 in the frangible projecting tab 42 of FIG. 4A can be substantially aligned with an interior edge 58 of the flange 26 in that the reduced thickness 50 of the frangible projecting tab 42 as compared to the thickness of the 52 of the flange 26 is provided along the interior edge 58 of the flange 26 along the full coupling length of the frangible projecting tab 42 to the flange 26. In another example, the area of weakness 54 in the frangible projecting tab 142 in the embodiment depicted in FIG. 4B can be substantially aligned with the interior edge 58 of the flange 26 in that the scored line 56 in the frangible projecting tab 142 providing the area of weakness 54 follows along the interior edge 58 of the flange 26. By substantially aligning the area of weakness 54 with the interior edge 58 of the flange 26, an aesthetic, clean interior edge 58 of the interior portion 27 of the flange 26 can be provided after the frangible projecting tab 42 is broken away from the container 10 by a user opening the container body 14.

However, it is also contemplated that the area of weakness 54 of the frangible projecting tab 242, 342 is not substantially aligned with the interior edge 58 of the flange 26. For example, in the embodiments of the frangible projecting tabs 242, 342 depicted in FIGS. 4C and 4D the area of weakness 54 is offset from the interior edge 58 of the flange 26.

Figure 4B:
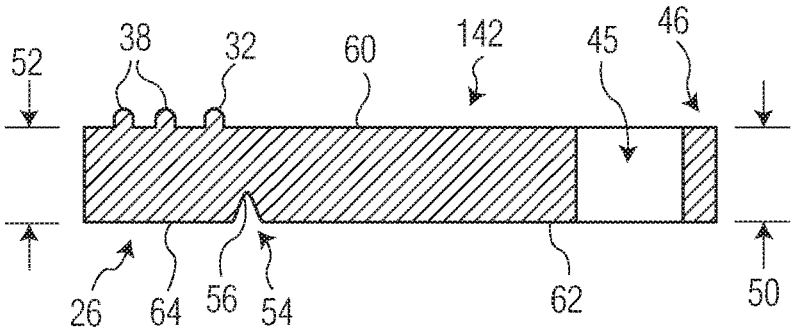
FIG. 4B representatively shows a cross-sectional view taken along line 4-4 in FIG. 3 similar to FIG. 4A, but of an alternative embodiment of a frangible projecting tab.
Figure 4C:
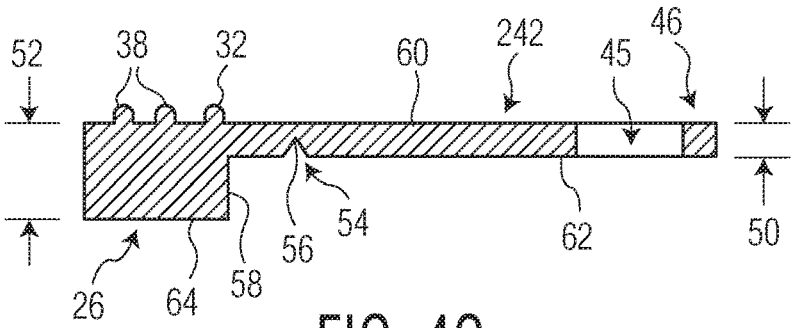
FIG. 4C representatively shows a cross-sectional view taken along line 4-4 in FIG. 3 similar to FIGS. 4A and 4B, but of yet another alternative embodiment of a frangible projecting tab.
Figure 4D:
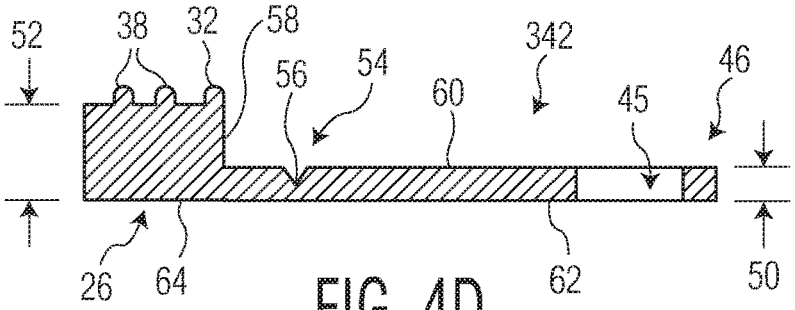
FIG. 4D representatively shows a cross-sectional view taken along line 4-4 in FIG. 3 similar to FIGS. 4A, 4B, and 4C, but of still another alternative embodiment of a frangible projecting tab.

The embodiment of the frangible projecting tab 342 of FIG. 4D provides additional alternative configurations of aspects of the frangible projecting tab 342. For example, the scored line 56 in the frangible projecting tab 342 of FIG. 4D is disposed in the top surface 60 of the frangible projecting tab 342, whereas the scored line 56 in the embodiments depicted in FIGS. 4B and 4C is in the bottom surface 62 of the frangible projecting tab 242, 342, respectively. Additionally, the bottom surface 62 of the frangible projecting tab 342 can be substantially aligned in a plane with a bottom surface 64 of the flange 26. In other embodiments in which the thickness 50 of the frangible projecting tab 42, 242 is less than the thickness 52 of the flange 26, the bottom surface 62 of the frangible projecting tab 42, 242 is not aligned with a plane of the bottom surface 64 of the flange 26. The configuration of aligning the bottom surface 62 of the frangible projecting tab 342 with the bottom surface 64 of the flange 26 may provide for easier coupling a portion of the frangible projecting tab 342 with the removable portion 18 of the container body 14.

Figure 5:
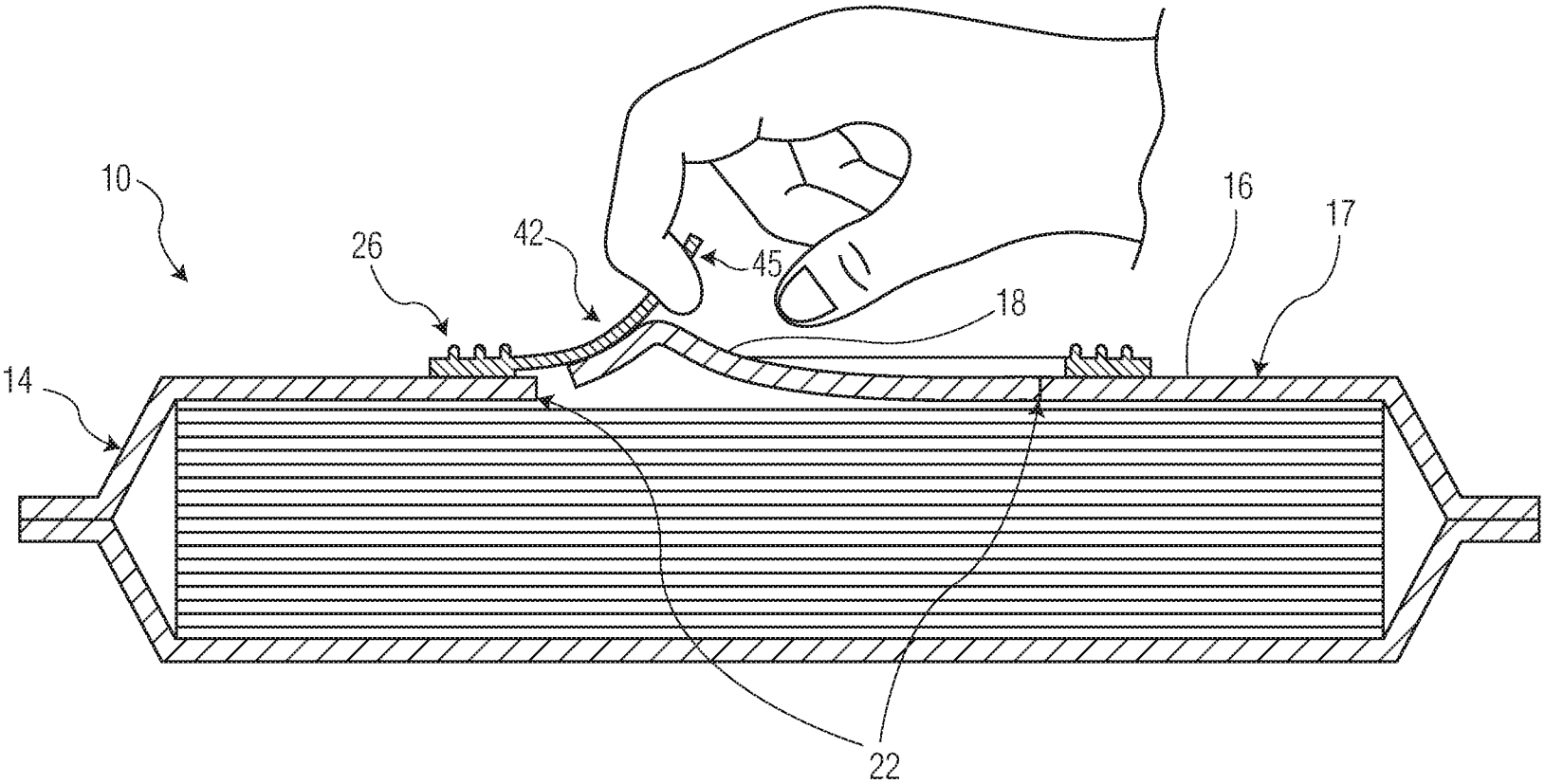
FIG. 5 representatively shows a cross-sectional view taken along line 5-5 in FIG. 2, with the frangible projecting tab being moved to begin tearing the removable portion of the container body.

The frangible projecting tab 42 can provide a user with a benefit of enhanced ease of opening of the container body 14. With respect to FIG. 5, a user can apply a force, or pull, on the frangible projecting tab 42 in such a fashion to pull the frangible projecting tab 42 away from the outer surface 17 of the container body 14. Because at least a portion of the removable portion 18 is coupled to the proximal end 44 of the frangible projecting tab 42, pulling on the frangible projecting tab 42 can help at least partially separate the removable portion 18 of the container body 14 from the top portion 16 of the container body 14, for example, along line of weakness 22 on the container body 14. In some embodiments, by having at least a portion of the distal end 46 of the frangible projecting tab 42 not coupled to the removable portion 18 of the container body 14, a user's finger may have improved access to pull the frangible projecting tab 42 away from the outer surface 17 of the container body 14. As depicted in FIG. 5, the opening 45 in the frangible projecting tab 42 can also provide a convenient location for a user to grip the frangible projecting tab 42.

As a user continues to pull on the frangible projecting tab 42, the frangible projecting tab 42 will have a bending moment applied to it that upon reaching a particular bending moment, the frangible projecting tab 42 will break away from the flange 26, such as at the area of weakness 54 described above and labeled in FIGS. 4A-4D. Once the frangible projecting tab 42 breaks away from the container 10, the user can continue to grasp the frangible projecting tab 42 and/or the removable portion 18 of the container body 14 to full remove the removable portion 18 of the container body 14. The frangible projecting tab 42 can be discarded with the removable portion 18 of the container body 14. The user now has access to the sheet products 12 within the container body 10 when the lid 24 is in an open position with respect to the flange 26, such as depicted in FIGS. 6 and 7.

By providing a repeatable gripping point, the frangible projecting tab 42 can provide easy and intuitive access for tearing the container body 14 along the line of weakness 22 defining the removable portion 18 of the container body 14. As such, the frangible projecting tab 42 may reduce the likelihood that a user may tear the container body 14 outside of the line of weakness 22, which may lead to sealing issues of the container 10. The frangible projecting tab 42 can also reduce the likelihood that a user may damage products 12 within the container 10, or create bunching of the first or first several products 12 within the container 10. Bunching of the sheet products 12 can prevent improper dispensing of future products due to minimal "head space" between the top of the stack of products 12 and the top portion 16 of the container body 14. Thus, the frangible projecting tab 42 can help reduce the possibility for sheet products 12 to become stuck or tear, which is frustrating to the consumer and can result in an inferior product experience.

In preferred embodiments, the container body 14 can be configured as a flexible film pouch and can be formed from materials known in the art, such as polymers, including but not limited to polyethylene, polypropylene, polyesters, and the like, and combinations thereof.

The products 12, e.g., wipes or wet wipes, can be arranged in the container body 10 in any manner which provides convenient and reliable one at a time dispensing and which assists the wipes in not becoming dirty and/or overly dry. For example, the wipes may be arranged in a container 10 as a plurality of individual sheets arranged in a stacked configuration to provide a stack of wipes which may or may not be individually folded. The wipes may be individual wipes which are folded in a c-fold, z-fold, quarter fold or other zigzag fold or interfolded or non-interfolded configurations as are known to those skilled in the art. The product 12 may include a plurality of wipes stacked one on top of each other in a non-interfolded configuration, for "reach-in" dispensing. For such a non-interfolded wipe, each wipe is folded onto itself with no portion of another wipe being positioned between or underneath any portion of the folds of the adjacent wipe(s). These configurations for wipes, as well as those discussed herein, may be provided by means known to those skilled in the art.

Alternatively, the individual wipes can be interfolded or in other ways related such that the leading and trailing end edges of successive wipes in the stacked configuration overlap, for "pop-up" dispensing. In such a configuration, the leading end edge of the trailing wipe is loosened from the stack by the trailing end edge of the leading wipe as the leading wipe is removed by the user. The wipes can be interfolded to facilitate such dispensing by means known to those skilled in the art.

Yet alternatively, the wipes can be arranged in the container 10 as a continuous web of interconnected wipes which are folded in an accordion-like stacked configuration or a roll. The individual wipes can be connected together along lines of frangibility, such as lines of perforations, to ensure that the trailing wipe is in position for grasping by the user after the leading wipe is removed. For example, the wipes can be provided by a continuous web of material which has a series of lines of frangibility extending across the width of the web. The portion of the web of material between successive lines of frangibility provides each individual wipe. The lines of frangibility can be provided by means known to those skilled in the art such as perforations, indentations, or cuts in the web of material. For example, the lines of frangibility or perforations can be provided in the web of material by passing the web of material between a die cutter roll and anvil roll. After the lines of frangibility have been incorporated into the web of material, the web can then be arranged in a stacked configuration for easy insertion into the pouch during formation thereof.

The container 10 of the present invention can include any suitable number of individual wipes depending upon the desired packaging and end use. For example, the container 10 can be configured to include a stack of wipes which can include at least about 5 wipes and desirably from about 8 to about 320 individually wipes, and more desirably from about 16 to about 64 wipes. The size and shape of the stack of wipes is dependent upon the size and shape of the container 10 and vice versa.

Each wipe is in particular embodiments generally rectangular in shape and defines a pair of opposite side edges and a pair of opposite end edges which can be referred to as a leading end edge and a trailing end edge. The leading end edge of each wet wipe is typically positioned in the pouch to be grasped by a user to facilitate a removal of the wipe from the container.

Materials suitable for the wipes of the present disclosure are well known to those skilled in the art. For wet wipes, these can be made from any material suitable for use as a moist wipe, including meltblown, coform, air-laid, bonded-carded web materials, hydroentangled materials, high wet-strength tissue and the like, and can comprise synthetic or natural fibers or combinations thereof. The wipes of the different aspects of the present invention can contain a liquid which can be any solution which can be absorbed into the wipes, thus making them "wet wipes." The liquid contained within the wet wipes can include any suitable components which provide the desired wiping properties.

As with the other container 10 of the disclosure, the container body 14 and/or rigid flip top 20 can be transparent or translucent to provide an indication of the quantity of wipes remaining in the container 10. The container body 14 and/or rigid flip top 20 can be made of various polymers, copolymers, and mixtures, including, e.g., polyethylene, polypropylene, polyester, polystyrene, and other polymers.

The different aspects and features of the present invention can in particular embodiments provide containers for sheet products, such as wipes, which, when compared to conventional containers for wipes, can provide improved access to the wipes and/or provide improved wipe dispensing. While the invention has been described in detail with respect to the specific aspects thereof, it will be appreciated that those skilled in the art, upon attaining an understanding of the foregoing, may readily conceive of alterations to, variations of, and equivalents to these aspects. Accordingly, the scope of the present invention should be assessed as that of the appended claims.

EMBODIMENTS

Embodiment 1: A storing and dispensing container for a plurality of sheets of product, the container comprising: a container body including a top portion, the top portion including a removable portion; a flange defining an interior portion, the flange being coupled to the top portion of the container body, the interior portion defined by the flange and surrounding the removable portion of the container body; a frangible projecting tab extending from the flange into the interior portion of the flange and over the removable portion of the container body, the frangible projecting tab being coupled to the removable portion of the container body; and a lid coupled to the flange.

Embodiment 2: The container of embodiment 1, wherein the frangible projecting tab includes an area of weakness configured to break upon a force applied to a portion of the frangible projecting tab.

Embodiment 3: The container of embodiment 2, wherein the area of weakness comprises an area of the frangible projecting tab that has a thickness that is less than a thickness of an adjacent area of the frangible projecting tab.

Embodiment 4: The container of embodiment 2 or 3, wherein the area of weakness comprises a scored line in the frangible projecting tab.

Embodiment 5: The container of any one of the preceding embodiments, wherein a portion of the flange adjacent the frangible projecting tab provides a flange thickness, a portion of the frangible projecting tab adjacent the flange has a tab thickness, and wherein the tab thickness is less than the flange thickness.

Embodiment 6: The container of any one of embodiments 2-4, wherein the flange includes an interior edge, the interior edge defining the interior portion, and wherein the area of weakness of the frangible projecting tab is substantially aligned with the interior edge of the flange.

Embodiment 7: The container of any one of the preceding embodiments, wherein the frangible projecting tab is integrally formed with the flange.

Embodiment 8: The container of any one of the preceding embodiments, wherein the frangible projecting tab comprises a proximal end and a distal end.

Embodiment 9: The container of embodiment 8, wherein at least a portion of proximal end of the frangible projecting tab is coupled to the removable portion of the container body.

Embodiment 10: The container of embodiment 8 or 9, wherein at least a portion of the distal end of the frangible projecting tab is not coupled to the removable portion of the container body.

Embodiment 11: The container of any one of embodiments 8-10, wherein the distal end is generally circular in shape and includes an opening.

Embodiment 12: The container of any one of the preceding embodiments, wherein the frangible projecting tab is coupled to the removable portion of the container body with adhesive.

Embodiment 13: The container of any one of the preceding embodiments, further comprising the plurality of sheets of product disposed within the container body.

Embodiment 14: The container of any one of the preceding embodiments, wherein the container body is a film.

Embodiment 15: A storing and dispensing container for a plurality of sheets of product, the container comprising: a container body including a top portion, the top portion including a removable portion; a flange defining an interior portion, the flange being coupled to the top portion of the container body, the interior portion defined by the flange and surrounding the removable portion of the container body; a frangible projecting tab extending from the flange into the interior portion of the flange, the frangible projecting tab being configured to be pulled by a user to break away from the flange and at least partially separate the removable portion of the container body from the top portion of the container body; and a lid coupled to the flange.

Embodiment 16: The container of embodiment 15, wherein the frangible projecting tab includes an area of weakness configured to break upon the force applied to the frangible projecting tab by the user.

Embodiment 17: The container of embodiment 15 or 16, wherein at least a portion of the frangible projecting tab is coupled to the removable portion of the container body.

Embodiment 18: The container of embodiment 16, wherein the frangible projecting tab comprises a proximal end and a distal end, and wherein the area of weakness of the frangible projecting tab is provided at the junction of the proximal end of the frangible projecting tab and the flange.

Embodiment 19: The container of any one of embodiments 15-18, wherein the container body is a film, and wherein the removable portion is defined by a line of weakness in the top portion of the container body.

Embodiment 20: The container of any one of embodiments 15-19, further comprising the plurality of sheet products disposed within the container body.

What is claimed is:

1. A storing and dispensing container for a plurality of sheets of product, the container comprising:

a container body including a top portion, the top portion including a removable portion;

a flange defining an interior portion, the flange being coupled to the top portion of the container body, the interior portion defined by the flange and surrounding the removable portion of the container body;

a frangible projecting tab extending from the flange into the interior portion of the flange and over the removable portion of the container body, the frangible projecting tab being coupled to the removable portion of the container body; and a lid coupled to the flange.

2. The container of claim 1, wherein the frangible projecting tab includes an area of weakness configured to break upon a force applied to a portion of the frangible projecting tab.

3. The container of claim 2, wherein the area of weakness comprises an area of the frangible projecting tab that has a thickness that is less than a thickness of an adjacent area of the frangible projecting tab.

4. The container of claim 2, wherein the area of weakness comprises a scored line in the frangible projecting tab.

5. The container of claim 2, wherein a portion of the flange adjacent the frangible projecting tab provides a flange thickness, a portion of the frangible projecting tab adjacent the flange has a tab thickness, and wherein the tab thickness is less than the flange thickness.

6. The container of claim 2, wherein the flange includes an interior edge, the interior edge defining the interior portion, and wherein the area of weakness of the frangible projecting tab is substantially aligned with the interior edge of the flange.

7. The container of claim 1, wherein the frangible projecting tab is integrally formed with the flange.

8. The container of claim 1, wherein the frangible projecting tab comprises a proximal end and a distal end.

9. The container of claim 8, wherein at least a portion of proximal end of the frangible projecting tab is coupled to the removable portion of the container body.

10. The container of claim 9, wherein at least a portion of the distal end of the frangible projecting tab is not coupled to the removable portion of the container body.

11. The container of claim 8, wherein the distal end is generally circular in shape and includes an opening.

12. The container of claim 1, wherein the frangible projecting tab is coupled to the removable portion of the container body with adhesive.

13. The container of claim 1, further comprising the plurality of sheets of product disposed within the container body.

14. The container of claim 1, wherein the container body is a film.

15. A storing and dispensing container for a plurality of sheets of product, the container comprising:

a container body including a top portion, the top portion including a removable portion;

a flange defining an interior portion, the flange being coupled to the top portion of the container body, the interior portion defined by the flange and surrounding the removable portion of the container body;

a frangible projecting tab extending from the flange into the interior portion of the flange, the frangible projecting tab being configured to be pulled by a user to break away from the flange and at least partially separate the removable portion of the container body from the top portion of the container body; and a lid coupled to the flange.

16. The container of claim 15, wherein the frangible projecting tab includes an area of weakness configured to break upon the force applied to the frangible projecting tab by the user.

17. The container of claim 15, wherein at least a portion of the frangible projecting tab is coupled to the removable portion of the container body.

18. The container of claim 16, wherein the frangible projecting tab comprises a proximal end and a distal end, and wherein the area of weakness of the frangible projecting tab is provided at the junction of the proximal end of the frangible projecting tab and the flange.

19. The container of claim 15, wherein the container body is a film, and wherein the removable portion is defined by a line of weakness in the top portion of the container body.

20. The container of claim 15, further comprising the plurality of sheet products disposed within the container body.

* * * * *